US010888210B1

(12) United States Patent
Vosbikian

(10) Patent No.: US 10,888,210 B1
(45) Date of Patent: Jan. 12, 2021

(54) CLEANING MITT

(71) Applicant: Peter S Vosbikian, Moorestown, NJ (US)

(72) Inventor: Peter S Vosbikian, Moorestown, NJ (US)

(73) Assignee: ZENITH INNOVATION, LLC, Moorestown, NJ (US)

( * ) Notice: Subject to any disclaimer, the term of this patent is extended or adjusted under 35 U.S.C. 154(b) by 0 days.

(21) Appl. No.: 16/833,952

(22) Filed: Mar. 30, 2020

Related U.S. Application Data

(60) Provisional application No. 62/940,287, filed on Nov. 26, 2019.

(51) Int. Cl.
*A47L 13/18* (2006.01)

(52) U.S. Cl.
CPC ..... *A47L 13/18* (2013.01)

(58) Field of Classification Search
CPC ..... A47L 13/18; B24D 15/045
See application file for complete search history.

(56) References Cited

U.S. PATENT DOCUMENTS

2012/0210532 A1* 8/2012 Slade, Jr. ..... A47L 13/18 15/227

FOREIGN PATENT DOCUMENTS

EP 0753280 B1 * 8/1999 ..... A46L 13/18

* cited by examiner

*Primary Examiner* — Shay Karls
(74) *Attorney, Agent, or Firm* — Stuart M. Goldstein

(57) ABSTRACT

A cleaning mitt has upper and lower material cleaning layers attached to form an interior pocket. The lower material cleaning layer has a bottom exterior side having a moderately abrasive first cleaning surface for light duty scrubbing and cleaning and a top interior side having a second cleaning surface less abrasive than the first cleaning surface for streak-free polishing. The upper material cleaning layer has a bottom interior side having a third cleaning surface which has the identical abrasiveness as the second cleaning surface and a top exterior side having a fourth cleaning surface which is more abrasive than the second and third cleaning surfaces for medium duty scrubbing and cleaning. A fifth cleaning surface partially circumscribes the cleaning layers for heavy duty scrubbing and cleaning. The fifth cleaning surface may also be provided as a scrubber patch on one of the cleaning layers.

9 Claims, 5 Drawing Sheets

CLEANING MITT

RELATED APPLICATION

This application claims the benefit of provisional application Ser. No. 62/940,287, filed on Nov. 26, 2019.

FIELD OF THE INVENTION

The present invention relates to cleaning mitts having a variety of different cleaning surfaces to address many different kinds of dirt and grime.

BACKGROUND OF THE INVENTION

Attempts have been made to provide cleaning mitts which are worn on the hand and are designed with different cleaning surfaces. However, most of these prior mitts do not have the versatility to adequately clean the many types of dirt, dust, and grime which are typically encountered. In fact, prior mitts are designed with no more than one or two different surfaces and thus their ability to clean up a variety of different substances is quite restricted. Prior mitts are also not ergonomically configured to allow the user to easily manipulate around corners, angled edges, and uneven surfaces, and generally to perform cleaning activities without soiling the user's hand.

SUMMARY OF THE INVENTION

It is thus the object of the present invention to provide a cleaning mitt with multiple cleaning surfaces, a mitt which is pliable and easy to use, and one which protects the user's hand from dirt, dust, grime, and other contaminates.

These and other objects are accomplished by the present invention, a cleaning mitt having upper and lower material cleaning layers attached to form an interior pocket. The lower material cleaning layer has a bottom exterior side having a moderately abrasive first cleaning surface for light duty scrubbing and cleaning and a top interior side having a second cleaning surface less abrasive than the first cleaning surface for streak-free polishing. The upper material cleaning layer comprises a bottom interior side having a third cleaning surface which has the identical abrasiveness as the second cleaning surface of the lower material cleaning layer and a top exterior side having a fourth cleaning surface which is more abrasive than the second and third cleaning surfaces for medium duty scrubbing and cleaning. A fifth cleaning surface is provided which partially circumscribes the upper and lower cleaning layers or consists of a scrubber patch, both options to be used for heavy duty scrubbing and cleaning.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
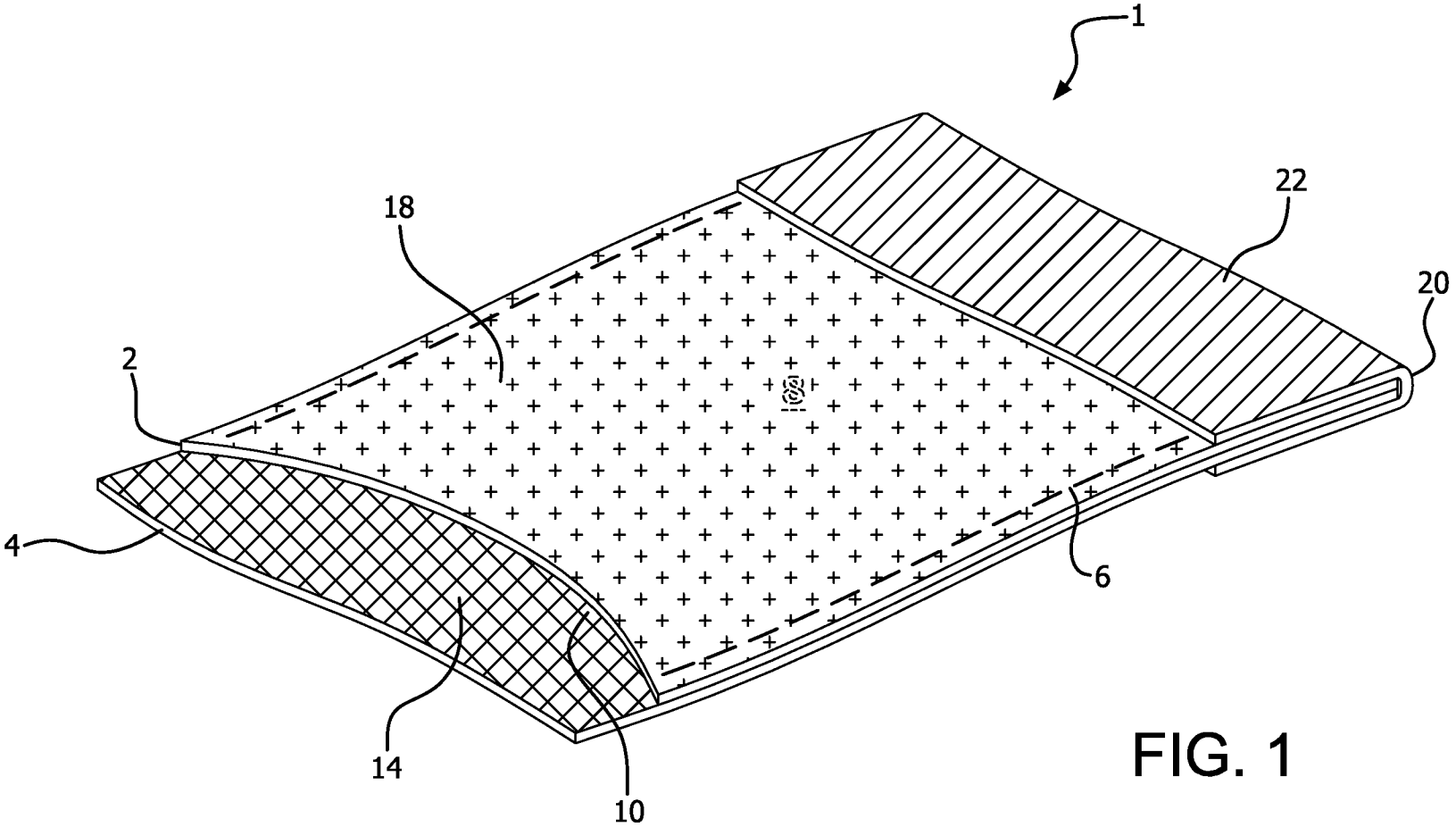
FIG. 1 is a top perspective view of the cleaning mitt of the present invention.
Figure 2:
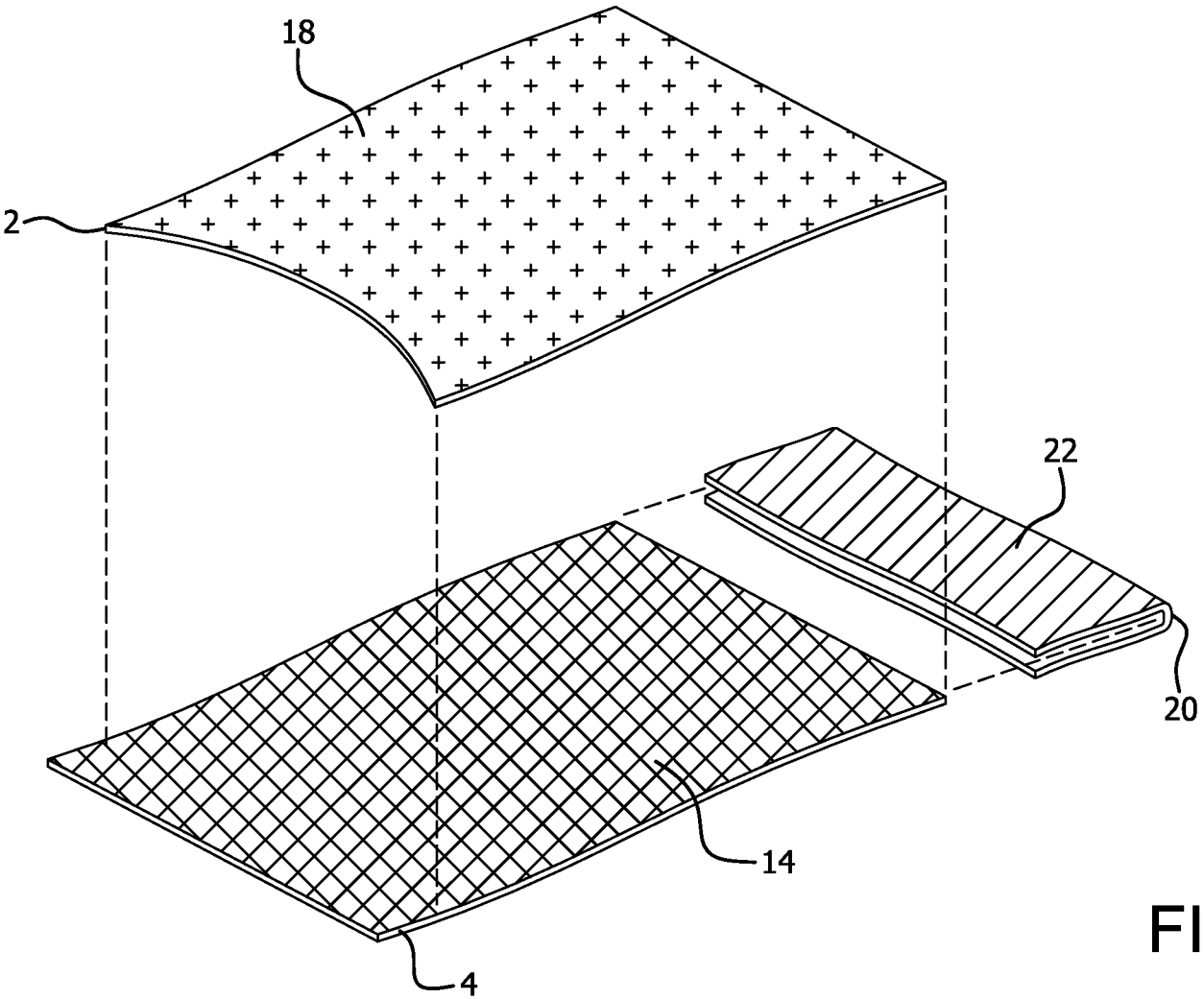
FIG. 2 is an exploded view of the cleaning mitt of the present invention.

Cleaning mitt 1 of the present invention comprises upper material cleaning layer 2 and lower material cleaning layer 4, attached together by means of stitching 6. Layers 2 and 4 form interior pocket 8 into which the user inserts his or her hand via opening 10. Pocket 8 is deep, allowing substantial coverage of the user's hand. In this manner the hand is protected from dirt and other contaminates on the surface being cleaned.

Lower material cleaning layer 4 comprises bottom exterior side having a moderately abrasive (first mitt) cleaning surface 12 for light duty scrubbing and cleaning, and top interior side having (second mitt) cleaning surface 14 which is different from surface 12 in that it is less abrasive and is for streak-free polishing.

Upper material cleaning layer 2 comprises bottom interior side having (third mitt) cleaning surface 16 which has the identical moderately abrasive surface as cleaning surface 14 of lower material cleaning layer 4, and top exterior side having (fourth mitt) cleaning surface 18 which is more abrasive than cleaning surfaces 14 and 16 for medium duty scrubbing and cleaning.

Cleaning element 20 is located at the distal end of mitt 1, partially circumscribing upper and lower material layers 2 and 4. Cleaning element 20 has (fifth mitt) cleaning surface 22 for heavy duty scrubbing and cleaning. Cleaning element 20 also serves to reinforce mitt 1 against tearing or in any manner coming apart.

As another option, in lieu of cleaning element 20, scrubber patch 24, with (alternate fifth mitt) cleaning surface 26 is provided for heavy duty scrubbing and cleaning. Scrubber patch 24 can be located on either upper material layer 2 or lower material layer 4.

Since cleaning surfaces 12, 18, and 22, and 14 and 16 have different degrees of abrasiveness, a single cleaning mitt can be used for attacking many different types of dirt and grime.

In view of the different surfaces, many types of material can be used, from micro-fiber sheets of varied degrees of abrasiveness to smooth, non-abrasive cloth material. However, it is contemplated that the surfaces of upper and lower material cleaning layers 2 and 4 can be made of any variety of micro-fiber, non-woven, or other equivalent material. In this regard the invention should not be considered restricted to the type of material which may be used.

In addition, although the herein disclosure describes the placement of specific cleaning surfaces on the upper and lower material cleaning layers, the invention should also not be considered so restricted. It is further contemplated that the placement of different cleaning surfaces on the exterior and interiors of cleaning layers is an inherent feature of the invention.

Figure 3:
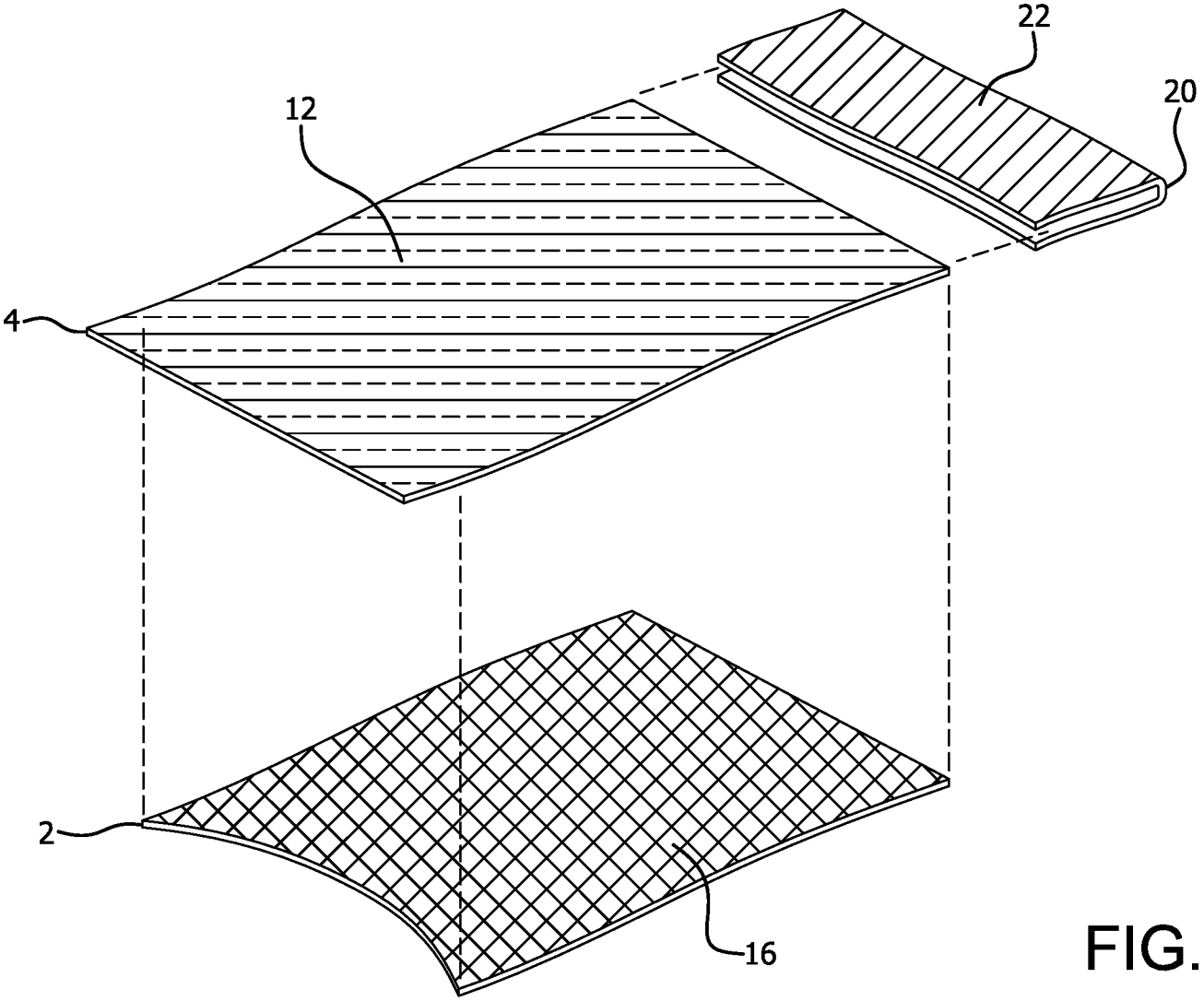
FIG. 3 is a bottom exploded view of the cleaning mitt of the present invention.
Figure 4:
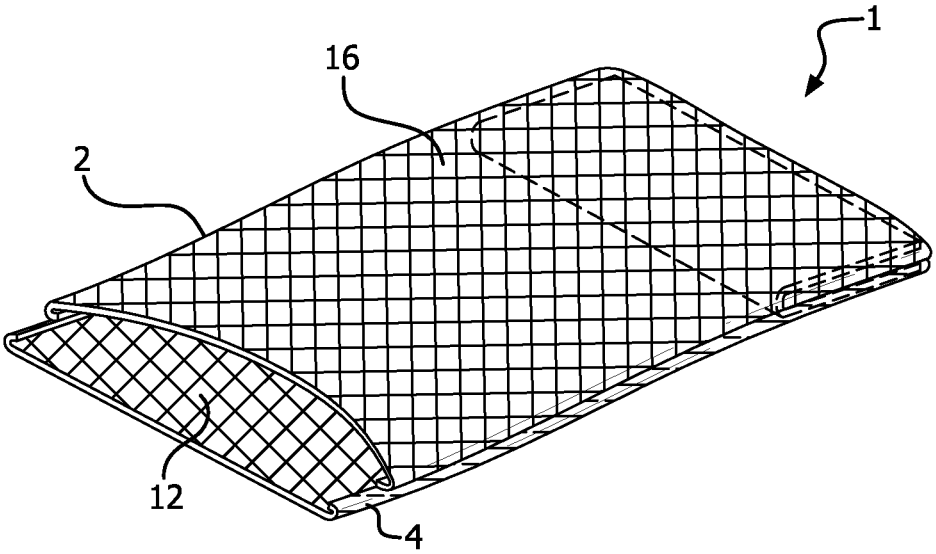
FIG. 4 is a top perspective view of the cleaning mitt of the present invention in its inside out position.
Figure 5:
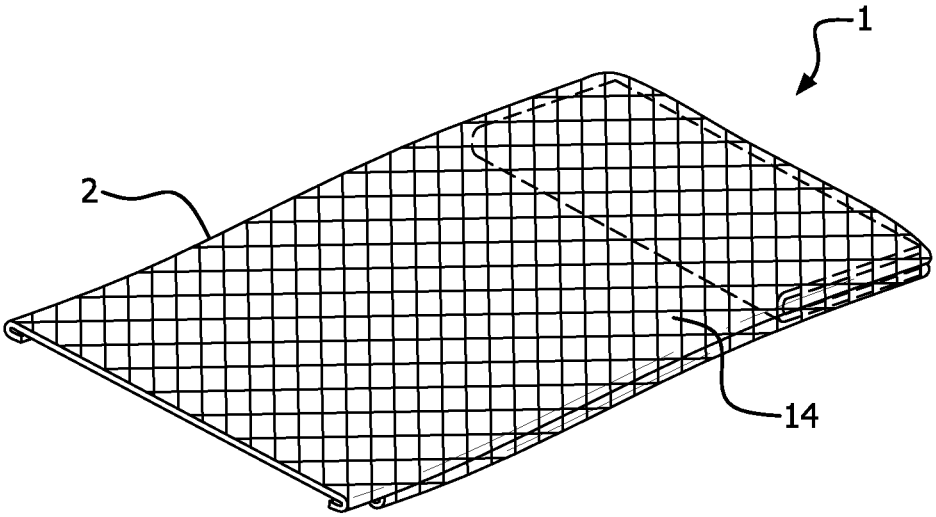
FIG. 5 is a bottom perspective view of the cleaning mitt of the present invention in its inside out position.
Figure 6:
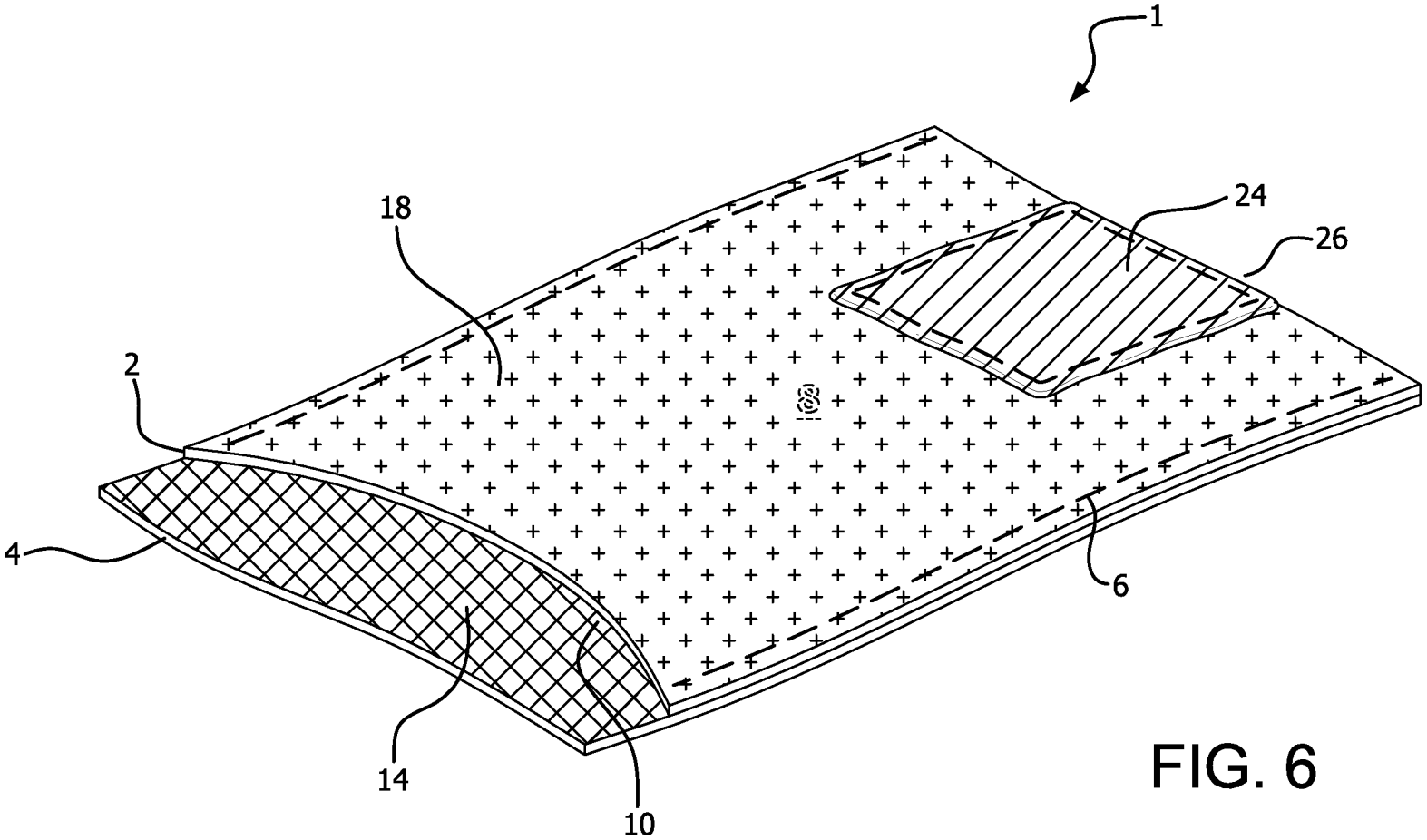
FIG. 6 is a top perspective view of the cleaning mitt of the present invention showing the incorporation of a scrubber patch.

In use, an individual places cleaning mitt 1 in a first configuration, as seen in FIG. 1, and then inserts his or her hand within pocket 8 of cleaning mitt 1, thus leaving cleaning surfaces 12, 18, and 22 or 26 exposed and available for cleaning different surfaces and different types of dirt. Cleaning mitt 1 can also literally be turned inside out into a second configuration, exposing surfaces 14 and 16 for additional, alternate cleaning. See FIG. 3.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A cleaning mitt comprising:

an upper material cleaning layer comprising a single, indivisible sheet of material attached to a lower material cleaning layer comprising a single, indivisible sheet of material, the upper material cleaning material sheet and the lower material cleaning layer sheet forming an interior pocket between the upper and lower material cleaning layers;

the lower material cleaning layer sheet of material comprising a bottom exterior side having a moderately abrasive first cleaning surface for light duty scrubbing and cleaning, and a top interior side having a second cleaning surface which is less abrasive than the first cleaning surface for streak-free polishing;

the upper material cleaning layer sheet of material comprising a bottom interior side having a third cleaning surface which has the identical abrasiveness as the second cleaning surface of the lower material cleaning layer, said upper material layer sheet having a top exterior surface which constitutes a fourth cleaning surface, the top surface itself being more abrasive than the second and third cleaning surfaces for medium duty scrubbing and cleaning.

2. The cleaning mitt as in claim 1 further comprising an opening for insertion of a user's hand into the pocket, wherein the cleaning mitt is useable in a first configuration with the first and fourth surfaces positioned for scrubbing and cleaning and in a second configuration in which the cleaning mitt is turned inside out with the second and third surfaces positioned for scrubbing and cleaning.

3. The cleaning mitt as in claim 1 further comprising a fifth cleaning surface located over at least one of the material cleaning layers.

4. The cleaning mitt as in claim 3 wherein the fifth cleaning surface comprises a cleaning element which partially circumscribes the upper and lower material cleaning layers for heavy duty scrubbing and cleaning.

5. The cleaning mitt as in claim 4 wherein the fifth surface is located on a cleaning element positioned at the distal end of the cleaning mitt.

6. The cleaning mitt as in claim 3 wherein the fifth cleaning surface is located on a scrubber patch.

7. The cleaning mitt as in claim 3 wherein the fifth surface is located on a scrubber pad.

8. The cleaning mitt as in claim 2 further comprising a fifth cleaning surface partially circumscribing the upper and lower material cleaning layers for heavy duty scrubbing and cleaning.

9. The cleaning mitt as in claim 8 wherein the fifth surface is located on a cleaning element positioned at the distal end of the cleaning mitt.

* * * * *